United States Patent [19]

Yunes

[11] Patent Number: 4,612,706

[45] Date of Patent: Sep. 23, 1986

[54] FOLDING KNIFE

[76] Inventor: Yamil R. Yunes, P.O. Box 573, Roma, Tex. 78584

[21] Appl. No.: 653,553

[22] Filed: Sep. 24, 1984

[51] Int. Cl.[4] ..... B26B 3/06

[52] U.S. Cl. ..... 30/160; 30/161

[58] Field of Search ..... 30/160, 161, 158, 153

[56] References Cited

U.S. PATENT DOCUMENTS

| | | | |
|---|---|---|---|
| 947,980 | 2/1910 | Romano | 30/153 |
| 1,478,260 | 12/1923 | Sibley | 30/160 X |
| 3,868,774 | 3/1975 | Miori | 30/161 |

*Primary Examiner*—James M. Meister
*Assistant Examiner*—John L. Knoble
*Attorney, Agent, or Firm*—G. Turner Moller; G. Turner Moller

[57] ABSTRACT

A folding knife has a handle and a blade pivotally connected to the handle. A linkage mechanism connects the pivoted blade to an operating lever at the base of the handle. The connection between the linkage mechanism and the operating lever constitutes a toggle. Thus, when the blade is in its open position, the toggle arrangement maintains the blade in a solid, non-wobbling position.

9 Claims, 5 Drawing Figures

FOLDING KNIFE

This invention relates to folding knives and more particularly to heavy duty folding knives of the type which may be used by hunters, campers, fishermen or the like.

All folding knives have some provision to hold the blade in the open or extended position so that the user is not injured by the blade accidently pivoting toward its sheathed or collapsed position. These locking mechanisms of the prior art vary widely in their approach and vary widely in creating stable, solid knives which are capable of heavy duty use. Accordingly, persons seeking heavy duty use from a knife have, in the past, almost universally selected one piece knives in which the blade is rigidly connected with the handle. Such knives are necessarily bulky and must be carried in a scabbard.

Attempts have been made in the prior art to provide folding knives of such stability and solidness as to be equivalent to the one piece or so-called hunting knives. Although heavy duty folding knives have been offered from time to time, none has been an overwhelming success in providing a solid, stable knife of great durability.

A disclosure of some interest relative to this invention is found in U.S. Pat. No. 947,980.

It is an objective of this invention to provide a heavy duty folding knife which, in its open or extended position, is exceptionally solid and stable. The aim is to provide a knife having the attributes of a one piece knife until it is folded.

In the knife of this invention, a blade is pivotally mounted to a handle for movement between an extended or open position toward a sheathe or collapsed position. A linkage mechanism resides inside the handle and is pivotally connected at one end to the blade. At the other end, the linkage mechanism pivotally connects to an operating lever pivoted to the handle. In the extended position of the blade, the blade abuts a portion of the handle to prevent further rotation. The arrangement between the linkage mechanism and the operating lever defines, in the extended position of the blade, an over-center toggle preventing the blade from rotating toward the closed position.

When it is desired to fold the knife, the operating lever is manipulated to break the toggle whereupon the blade may be moved to its collapsed position. After the blade is in its collapsed position, the operating lever is returned to its toggle position so that the operating lever and linkage again forms an over-center toggle preventing the blade from movement away from its collapsed position.

It is accordingly an object of this invention to provide an improved folding knife.

Another object of this invention is to provide a heavy duty folding knife which is exceptionally solid and stable in both its open and collapsed positions.

Other objects and advantages of this invention will become more fully apparent as this description proceeds, reference being made to the accompanying drawings and appended claims.

IN THE DRAWINGS

Figure 1:
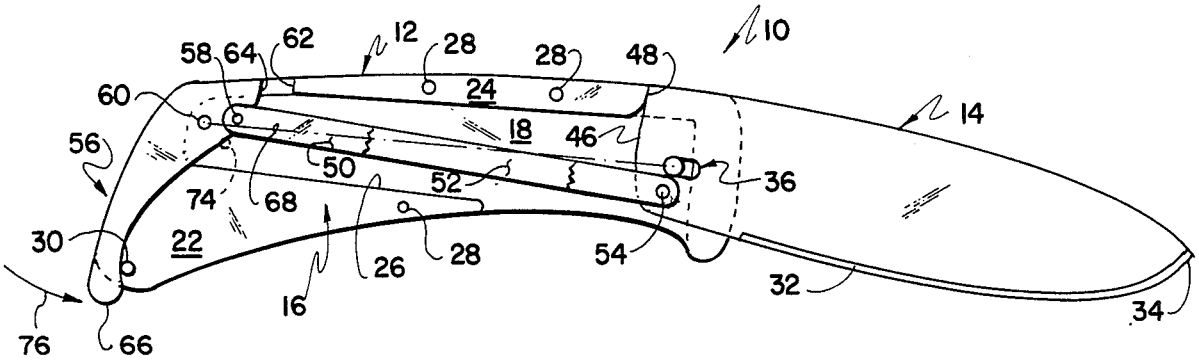
FIG. 1 is a side elevational view of the folding knife of this invention in its open position, certain parts being broken away for clarity of illustration.
Figure 3:
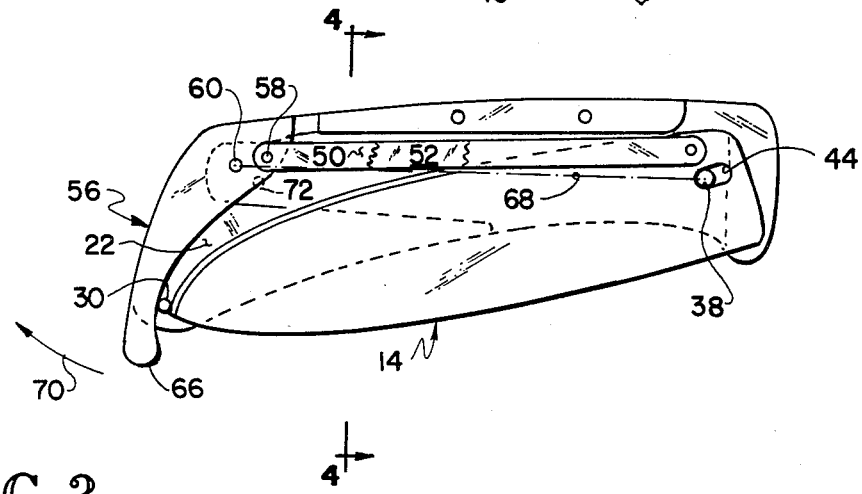
FIG. 3 is a view similar to FIG. 1 and 2 illustrating the folding knife of this invention in its collapsed position.
Figure 4:
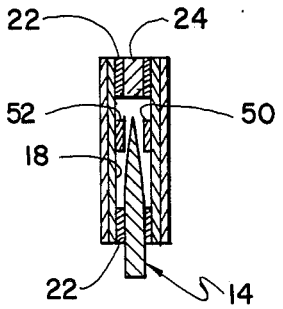
FIG. 4 is a longitudinal cross-sectional view of the knife of this invention taken substantially along line 4—4 of FIG. 1 as viewed in the direction indicated by the arrows.
Figure 5:
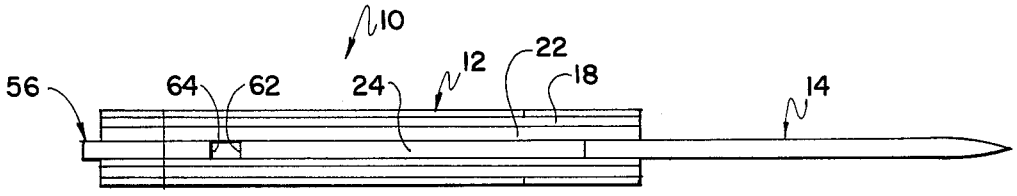
FIG. 5 is a top view of the knife of FIGS. 1–4.

Referring to the drawings, a folding knife 10 of this invention comprises, as major components, a handle 12, a blade 14 and a toggle mechanism 16 locking the blade 14 in its open extended position illustrated in FIG. 1 and for locking the blade 14 in its collapsed or sheathed position illustrated in FIG. 3.

The handle 12 is assembled from a plurality of sheet metal pieces which conveniently are stamped from suitable material, such as brass, stainless steel or the like. The handle 12 comprises a pair of outside liners 18 to which suitable decorative handle material 20, such as bone or the like, may be secured. A pair of inside liners 22 are disposed adjacent the outside liners 18 and are spaced apart by an elongate planar rib 24. The inside liners 22 and rib 24 provide an internal slot 26 for receiving part of the toggle mechanism 16 as will be more fully apparent hereinafter. The liners 18, 22 and the rib 24 are connected together by pins or rivets 28, 30, as is customary in the manufacture of knives.

It will be seen that the inside liners 22 are spaced apart by the thickness of the rib 24 thereby accommodating movement of the blade 14 into a partially nested position between the liners 22 in the collapsed position as shown best in FIG. 3. It will also be seen that the pins 28 extend through the liners 18, 22 and the rib 28 as well as any decorative handle material 20. The pin 30 extends across the gap between the inner liners 22 for purposes more fully explained hereinafter.

The blade 14 may be of any suitable type having a sharpened edge 32 and a point 34. The blade 14 is pivotally mounted onto a handle 12 by means 36 allowing rotary movement of the blade 14 about the axis of the pin 38 as suggested by the arrow 40 and for allowing limited linear movement as suggested by the arrow 42 in FIG. 2. The means 36 accordingly includes an elongated slot 44 formed in the blade 14. Desirably, the slot 44 has a minor dimenision substantially the same as the diameter of the pin 38 and a major dimension which is sufficient to allow movement of the blade 14 from its extended position shown in FIG. 1 to its partially collapsed position shown in FIG. 3.

The blade 14 also comprises a rear shoulder 46 which abuts a front shoulder 48 in the extended position of the blade 14 as shown in FIG. 1. Accordingly, engagement of the shoulders 46, 48 provides one limit of the extent of pivotal movement in the direction shown by the arrow 40.

The toggle mechanism 16 acts to lock the blade 14 in its extended position shown in FIG. 1 and in its collapsed or sheathed position shown in FIG. 3. The toggle mechanism 16 includes a pair of links 50, 52 pivotally connected at one end to the blade 14 by a suitable pin 54. The links 50, 52 are accordingly spaced apart by the width of the blade 14 to allow the blade 14 to partially nest therebetween as shown best in FIG. 3.

The opposite ends of the links 50, 52 are pivotally connected to an operating lever 56 by a suitable pin 58.

Conveniently, the operating lever 56 is a generally L-shaped structure pivoted to the handle 12 by a pin 60 which passes through the liners 18, 22. Desirably, the operating lever 56 is of substantially the same thickness as the rib 24 and as the rear end of the blade 14. It will be seen that the rearward end 62 of the rib 24 terminates slightly short of the forward end 64 of the lever 56 thereby to allow unobstructed pivotal movement of the lever 56. The lever 56 perferably includes an enlarged end 66 extending beyond the confines of the handle 12 so that the lever 56 may easily be grasped by a user.

Figure 2:
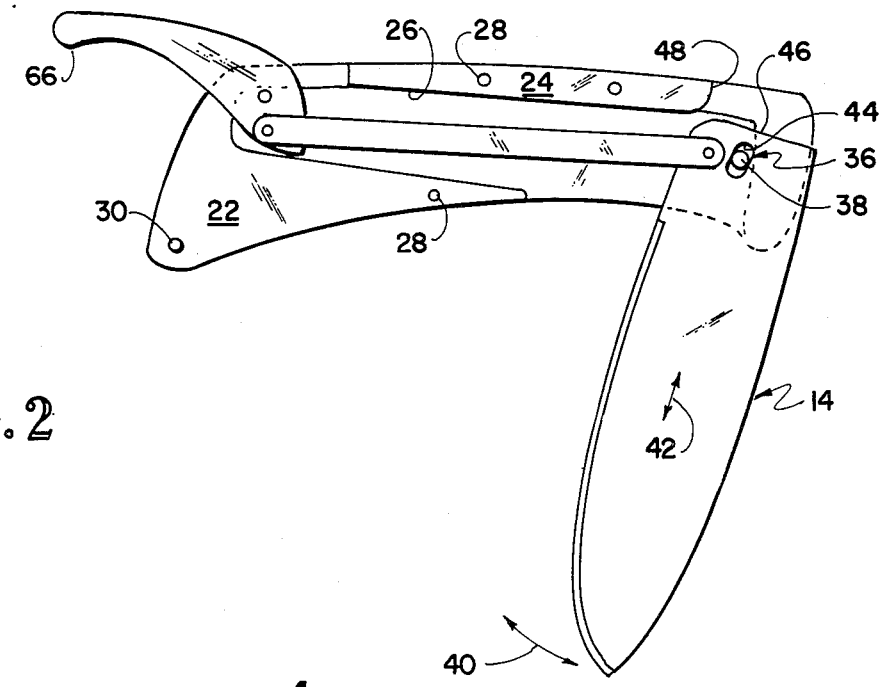
FIG. 2 is a view similar to FIG. 1 illustrating the folding knife of this invention during blade movement between its open position and its collapsed position.

As will be evident to those skilled in the art, the operating lever 56 has a locking position shown in FIGS. 1 and 3 and an unlocking position shown in FIG. 2. It will also be apparent to those skilled in the art that the arrangement between the operating lever 56, the links 50, 52 and the blade 14 comprises an over-center toggle which acts to lock the blade 14 against the shoulder 48 in the extended position of FIG. 1 and acts to lock the blade 14 in its collapsed position of FIG. 3.

As shown in FIG. 3, the blade 14 is in a locked position because the pivot pin 58 is disposed above an imaginary line 68 passing between the operating lever pivot pin 60 and the knife pivot pin 38. If an individual were to attempt to unfold the blade 14 without moving the operating lever 56, the links 50, 52 would attempt to move to the left in FIG. 3 thereby attempting to rotate the operating lever 56 in a counterclockwise direction which is prevented by the lever 56 engaging the pin 30.

When it is desired to open or unfold the knife 10, the user grasps the handle end 66 and rotates it in a clockwise direction shown by the arrow 70. Initial rotation of the operating lever 56 in the clockwise direction causes the pivot pin 58 to move from its locked position toward a free position 72 shown in dashed lines. At the free position 72, leftward movement of the links 50, 52 is allowed thereby allowing the blade 14 to unfold, either by directly manipulating the blade 14 or by pivoting the lever 56.

After the toggle is broken in the sheathed position, the blade 14 is rotated in a counterclockwise direction until the shoulder 46 abuts the shoulder 48 of the rib 24. With the blade 14 in its extended position, the operating lever 56 assumes a generally upwardly inclined position relative to the handle 12. In the phantom line position of the operating lever 56, the blade 14 is not locked against the shoulder 48. Accordingly, the pivot pin 58 is at a dash line position 74 which is comparable to the free position 72 in FIG. 3. In order to lock the blade 14 in the extended position, the user merely pivots the operating lever 56 forcibly in a counterclockwise direction as shown by the arrow 76. This moves the pivot pin 58 above the imaginery line 68. If one were to attempt to fold the blade 14 toward its sheathed position without breaking the toggle mechanism 16, attempted leftward movement of the links 50, 52 merely forces the operating lever 56 in a counterclockwise direction against the pin 30. It will accordingly be seen that the blade 14 is immobile. Models of this invention have exhibited exceptional qualities of stability and solidity in both the locked extended position and in the locked sheathed position.

Although the invention has been described in its preferred forms with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. A folding knife comprising a handle, a blade and means pivotally connecting the blade to the handle for rotation, about a first axis, for movement between a first extended postion in which the blade and handle abut, a second intermediate position and a third collapsed position; and toggle means enabling blade movement from the second position to the first position and for locking the blade against the handle in the first position including an operating lever pivotally connected to the handle for rotation about a second axis, the first and second axes defining an imaginary line therebetween; and a link pivotally connected at a first location to the lever and at a second location to the blade for movement between a second unlocked position, corresponding to the second blade position, in which both locations reside on the same side of the imaginary line and a first locked position, corresponding to the first blade position, in which the first and second locations are on opposite sides of the imaginary line, the link and the operating lever defining an over-center toggle in the extended position of the blade.

2. The folding knife of claim 1 wherein the first and second locations are on the same side of the imaginary line in the collapsed position of the blade and the link and the operating lever define an over-center toggle in the collapsed position of the blade.

3. The folding knife of claim 1 wherein the handle comprises a pair of substantially identical outer liners, a pair of inner liners between the outer liners and a rib between the inner liners and means connecting the liners and rib together, the inner liners being spaced apart to receive the blade, the blade abutting the rib in the extended position thereof.

4. The folding knife of claim 3 further comprising a second link parallel to the first link and wherein the inner liners define a slot receiving the links, the links being spaced apart to receive the blade therebetween.

5. The folding knife of claim 1 wherein the pivotal connecting means includes means allowing pivotal and linear movement between the handle and blades.

6. The folding knife of claim 1 wherein the pivotal connecting means includes a pin carried by the handle and a slot, provided by the blade, receiving the pin, the slot having a minor dimension substantially the same as the pin and a major dimension extending parallel to the blade, the major dimension being substantially longer than the minor dimension.

7. The folding knife of claim 6 wherein the handle provides a shoulder for abutting the blade in the extended position of the blade, the first axis being located between the shoulder and the second location in the extended position of the blade, the operating lever and link comprising means for pushing on the blade at the second location during movement of the link toward the first locked position.

8. A folding knife comprising a handle, a blade and means pivotally connecting the blade and handle for rotation about a first axis for movement between a first extending position in which the blade and handle abut, a second intermediate position, a third intermediate position and a fourth collapsed position; and toggle means enabling blade movement between the positions and for locking the blade in the first and fourth positions, including an operating lever pivotally connected to the handle for rotation about a second axis between a first locking position sheathed in the handle and a second unlocking position, the first and second axes defining an imaginary line therebetween; and a link pivotally connected at a first location to the lever and at a second location to the blade;

at the first blade position, the first and second locations being on opposite sides of the imaginary line and the operating lever being in the first locking position sheathed in the handle;

at the second blade position, the first and second locations being on the same side of the imaginary line and the operating lever being in the second position;

at the third blade position, the first and second locations being on opposite sides of the imaginary line and the operating lever being in the second position;

at the fourth blade location, the first and second locations being on the same side of the imaginary line and the operating lever being in the first locking position sheathed in the handle.

9. A folding knife comprising a handle, a blade and means pivotally connecting the blade to the handle for rotation, about a first axis, between a first extended position in which the blade and handle abut at a shoulder, a second intermediate position and a third collapsed position; and toggle means for locking the blade in the first position and enabling blade movement between the first and second positions, including an operating lever pivotally connected to the handle for rotation about a second axis, the first and second axes defining an imaginary line therebetween; and a link pivotally connected at a first location to the lever and at a second location to the blade;

at the first blade position with the operating lever being in the locked position, the imaginary line residing between the shoulder and the second location adjacent the first axis and the first location residing on the opposite side of the imaginary line from the second location;

the position of the second axis being that rotation of the operating lever from the locked position toward the unlocked position moves the first location across the imaginary line.

* * * * *